United States Patent [19]

Sartor

[11] Patent Number: 4,620,379

[45] Date of Patent: Nov. 4, 1986

[54] SKI BOOT, PARTICULARLY OF THE REAR ENTRANCE TYPE, INCORPORATING A CLOSURE AND FOOT SECURING DEVICE

[75] Inventor: Mariano Sartor, Montebelluna, Italy

[73] Assignee: Nordica S.p.A., Montebelluna, Italy

[21] Appl. No.: 741,062

[22] Filed: Jun. 4, 1985

[30] Foreign Application Priority Data

Jun. 13, 1984 [IT] Italy ..... 22279/84[U]

[51] Int. Cl.[4] ..... A43B 5/04; A43B 11/00

[52] U.S. Cl. ..... 36/119; 36/50; 36/58.5

[58] Field of Search ..... 36/117–121, 36/50, 58.5, 105; 24/68 SK

[56] References Cited

U.S. PATENT DOCUMENTS

| | | | |
|---|---|---|---|
| 3,808,644 | 5/1974 | Schoch | 24/68 SK |
| 4,160,332 | 7/1979 | Salomon | 36/119 |
| 4,428,130 | 1/1984 | Perotto | 36/117 |
| 4,513,520 | 4/1985 | Koch | 36/119 |

FOREIGN PATENT DOCUMENTS

| | | | |
|---|---|---|---|
| 0099504 | 2/1984 | European Pat. Off. | 36/117 |
| 0132744 | 2/1985 | European Pat. Off. | 36/117 |
| 6557 | of 1897 | United Kingdom | 36/58.5 |

*Primary Examiner*—James Kee Chi

*Attorney, Agent, or Firm*—Guido Modiano; Albert Josif

[57] ABSTRACT

The ski boot comprises a shell, having front and rear quarters hingedly connected thereto, and housing a foot instep presser. A cable is adapted to be actuated by a cable pulling element (of the type disclosed in an earlier U.S. Pat. No. 4,433,456 of this same applicant), actuable from the boots' exterior. The cable is arranged to tighten the front and rear quarters together, extend over the instep presser, rearwardly encompass an area occupied by the heel of the wearer's foot, and being connected at its other end to a fixed point on the ski boot.

12 Claims, 4 Drawing Figures

SKI BOOT, PARTICULARLY OF THE REAR ENTRANCE TYPE, INCORPORATING A CLOSURE AND FOOT SECURING DEVICE

BACKGROUND OF THE INVENTION

This invention relates to a ski boot, particularly of the rear entrance type, incorporating a closure and foot securing device.

As is known, rear entrance ski boots are generally fastened closed by means of levers, or the like arrangements, which are effective to tighten the boots' rear and front quarters together.

In an earlier U.S. Pat. No. 4,433,456 of this same Applicant which is incorporated hereto by reference, a closure device is disclosed which comprises a cable length, which tightens the rear and front quarters together when taken up on a cable take-up assembly supported at the boot quarters, to provide continuous accurate adjustment capabilities.

Also known, for example, from U.S. Patent Application Ser. No. 06/ 510,748 filed on July 5, 1983 of this same assignee, is the use, with rear entrance ski boots, of a foot securing device which comprises a cable length attached with one end to a take-up reel, of the type illustrated in the above-mentioned patent application, the cable extending over the foot instep and having its other end secured at a lateral position on the boot interior.

The known approaches just described afford the possibility of closing the ski boot with one device, and of gradually lowering the foot instep presser with another device, which could be structurally like the former, until a desired securing pressure is developed on the foot.

As may be appreciated, two separate operations are required, to close the boot and secure the foot.

SUMMARY OF THE INVENTION

It is the aim of this invention to provide a rear entrance ski boot which incorporates a closure device and a foot securing device, both devices being actuatable with a single operation, that is by means of a single device adapted for operation from the boot exterior which permits of closing the boot and securing the foot therein in one step, while affording independent adjustment capabilities of both clamping actions.

Within the above aim, it is a particular object of this invention to provide a ski boot which, while having greatly improved functional characteristics, is uncomplicated contruction-wise, and can make use of individually available elements on the market.

Another object of this invention is to provide a ski boot, whereby the boot itself can be closed and the foot secured with a pressure action which is spread and adjusted by the user as desired, whilst the boot is being worn, thereby it is no longer necessary to perform any subsequent series of adjustments until the desired securing pressure is obtained.

A not unimportant object of this invention is to provide a ski boot which has a simplified construction and a highly competitive cost.

The above aim and objects, as well as other objects which will be apparent hereinafter, are achieved by a ski boot, particularly of the rear entrance type, incorporating a closure and foot securing device, according to the invention, which comprises a shell whereto front and rear quarters are hingedly connected and housing a foot instep presser, and is characterized in that it comprises at least one cable having at least one end and at least one other end, said cable being attached with said at least one end to a cable pulling element, actuatable from the ski boot exterior, said cable being arranged to, encompass said rear quarter rearwardly thereof to tighten it against said front quarter, extend over said foot instep presser, rearwardly encompass the area occupied by the heel of the user's foot, and being connected with said at least one other end to at least one fixed point on said ski boot.

BRIEF DESCRIPTION OF THE DRAWINGS

Further features and advantages will become apparent from the following detailed description of a ski boot, particularly of the rear entrance type, incorporating a closure and foot securing device, with reference to the accompanying illustrative drawing, where.

DESCRIPTION OF THE PREFERRED EMBODIMENTS

Figure 4:
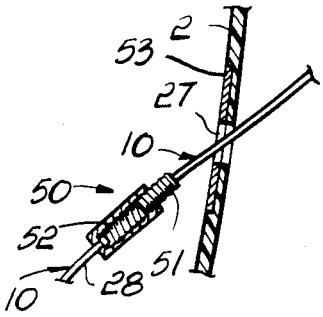
FIG. 4 shows schematically a device interposed on the cable and being effective to change the clamping force on the instep and heel relatively to the clamping force on the quarters.
Figure 2:
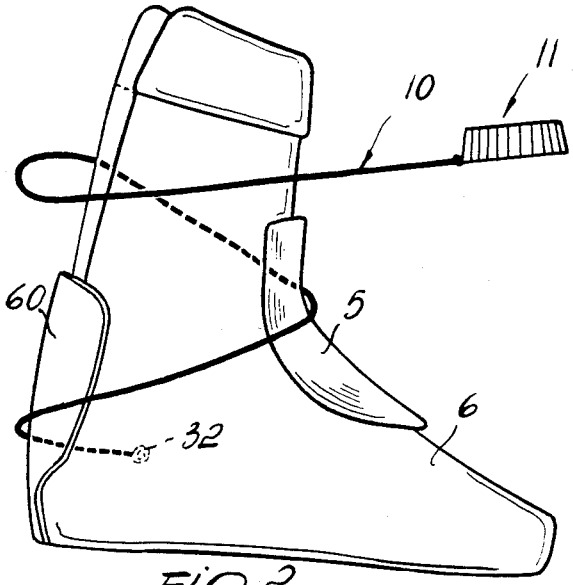
FIG. 2 illustrates schematically the layout of the cable for performing the closure function.
Figure 1:
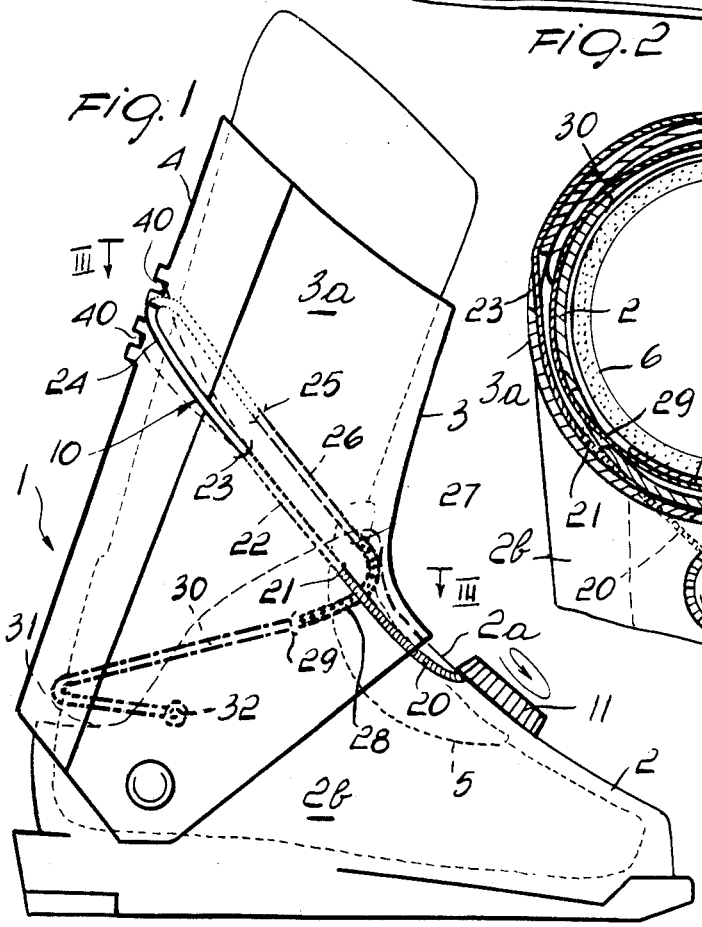
FIG. 1 shows schematically in side elevation view the ski boot incorporating the closure and foot securing device of this invention.

Making reference to the drawing views, a rear entrance ski boot, generally designated with the reference numeral 1, comprises as usual a shell 2, whereto there are hingedly connected for a pivotal movement about a substantially horizontal axis transversely to the main direction of the shell, a front quarter 3 and a rear quarter 4.

Figure 3:
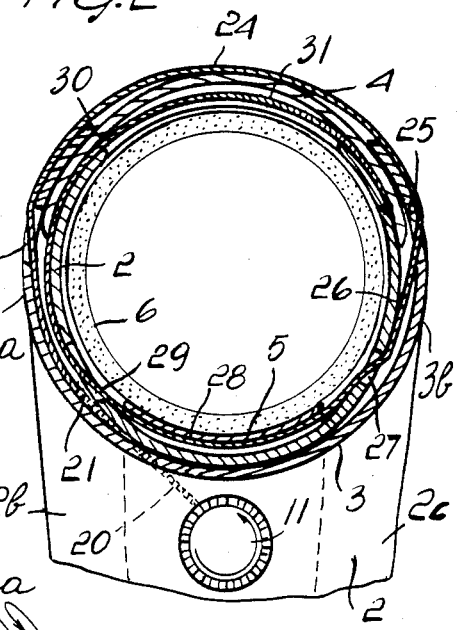
FIG. 3 is a schematical view taken along the line III—III in FIG. 1.

As visible in FIG. 3, the front quarter 3 has a pair of opposite lateral flap portions 3*a*, 3*b*. The quarter 3 at least partially overlaps an instep portion 2*a*, a heel portion 31 and opposite side portions 2*b* and 2*c* of the shell 2.

At the interior of the shell 2 at the foot instep zone defining instep portion 2*a* is a foot instep presser, indicated at 5, which is made from a substantially stiff material and has a mainly arcuated configuration to develop on its bottom face a shape matching substantially that of the foot region at which it is positioned, that is the foot instep or zone.

The presser 5, which is located inside the shell, is positioned externally to a soft inner shoe 6.

The boot is provided with a cable length, indicated at 10, which is advantageously routed through a flexible sheath; the cable 10 is attached, with one of its ends, to a pulling or tensioning means which consists, preferably but not necessarily, of a cable take-up reel and respective operating knob, generally indicated at 11, being of the type illustrated in the above-mentioned patent application, which has the function of applying a pull on the cable to produce, as explained herein below, the closure of the boot and securement of the foot.

The take-up reel, which may be replaced optionally with some other elements performing the same function, is preferably housed on the exterior i.e. accessible from to outside of the shell 2, at a front portion.

The cable 10 has a first section, indicated at 20, which extends from the take-up reel 11 inside the shell 2 and exits through a first opening 21 provided in the shell 2. The cable then extends outside the shell 2 between the shell and front quarter 3, at a front lateral area.

The cable 10 has a second section 22 which extends between the shell 2 and front quarter 3 as far as a second opening 23, through which the cable exits the front quarter 3 and is exposed on the boot exterior.

The second opening 23, which is formed in the front quarter, marks the beginning of a third section 24 of the cable, which encompasses the rear quarter 4 rearwardly thereof as far as a third opening 25, formed in the front quarter remotely from the second opening 23.

The cable then enters the third opening 25 and defines a fourth section, indicated at 26, which extends between the front quarter 3 and shell 2 as far as a fourth opening 27 provided in the shell 2 and located substantially symmetrically to the opening 21, through which the cable is led inside the shell and extends at a fifth section thereof 28 above the foot instep presser.

The fifth section 28 is terminated at a fifth opening 29, formed through the shell 2 and marking the beginning of a sixth section 30 of the cable 10 which extends between the shell and front quarter 3.

The section 30 encompasses the boot rearwardly at a heel zone defining heel portion i.e. at the depressed or recessed area 31 of the shell, so as to override the heel region or zone of the user's foot.

Then, the cable is connected to a fixed point on the shell, at a point 32 which is located laterally at the bottom of the boot inside.

The cable 10 may be inserted with its third section, i.e. in the area outside surface encompassing the rear quarter 4 rearwardly, into notches 40 defined by the quarter at spaced apart locations along the height of the quarter, thereby the cable is housed at different elevations to allow for different inclination angles and rear support, according to necessity.

It should be added to the foregoing that the cable 10, at the sections thereof which override the foot instep presser and the heel, may be provided with a device for changing the working lengths i.e. increasing or diminishing the length of said sections so as to make the clamping force exerted on the foot instep and heel unrelated to the clamping force which may be exerted on the quarters.

Such a device, being interposed to the cable 10 at the fifth section 28 thereof, is generally indicated at 50 and includes nipple-like connection with a threaded pawl or core formation 51 which is associated with an interrupted terminal portion of the cable 10 and engages rotatably in an inside threaded bushing 52 which is associated pivotally with another interrupted terminal portion of the cable 10.

At the inner face of the shell, in the area occupied by the opening 27, an abutment washer 53 is provided, against which the pawl 51 may engage such that on further tightening the cable 10 no increase in the clamping force on the foot instep and heel is brought about, but solely in the clamping force between the quarters.

In practical use, after the foot has been introduced into the boot, the user acts on the actuating element 11, causing the cable 10 to be wound on the reel provided inside the pulling element 11, with consequent clamping of the rear quarter 4 with respect to the front quarter 3 and consequent securing of the foot obtained by lowering the presser 5 against the foot instep and simultaneous clamping of the foot at the heel region which allows the effectuation of an accurate and effective securement of the foot.

It should be also added that at the heel region there may be provided a pressure distributor formed of a small protecting plate 60, optionally attached directly to the inner shoe 6, which practically increases the area of contact with the user's heel, avoiding objectionable localized pressure forces.

In particular the pulling element used is arranged to enable the user to perform a desired tightening action, by manipulating the knob of the pulling element 11, to be then sure that, once released, the knob will remain at the set position and prevent the cable from slackening, on changing the established conditions.

For releasing, it will be sufficient to operate the knob in the opposite direction, to quickly unwind the cable 10 from the reel of the pulling element 11, and consequently slacken the closure between the front and rear quarters, as well as the pressure action on the presser element and thrust action at the heel region.

An important feature of the invention is, therefore, that with a single actuating element, formed of the pulling element, one can both close and secure the foot inside the boot, using in practice a single cable which, by varying its length because of its being wound on the reel, allows the effectuation of all the adjustments sought.

It may be appreciated from the foregoing that the invention achieves its objects, and in particular that a ski boot is provided wherein a single cable effects, in one operation, all the steps of closing and securing the foot therein, which afford for the user an accurate and reliable securement of the foot inside the boot.

In practicing the invention, the materials used, so long as they are compatible with the intended use, and the dimensions and contingent shapes, may vary according to requirements.

I claim:

1. In a ski boot having a shell with an instep zone defining instep portion and an inside heel zone defining heel portion opposite said instep portion and opposite side portions connecting said instep portion with said heel portion, a front quarter hinged on said shell and having a pair of opposite lateral flap portions, said front quarter at least partially overlapping said instep portion and said opposite side portions and a rear quarter hinged on said shell and with a presser element in the zone of and below said instep portion and adapted to receive therein a user's foot with inner boot like means thereon, a closure and foot securing device comprising: cable means, first opening defining means in one of said opposite side portions at a distance from said heel portion for the passage of said cable means therethrough, second opening defining means in one of said opposite lateral flap portions of said front quarter, said second opening defining means being arranged rearwardly at a distance from said first opening defining means for the passage of said cable means through said second opening defining means, third opening defining means in another of said opposite lateral flap portions of said quarter for the passage therethrough of said cable means.

fourth opening defining means in another of said opposite side portions of said shell forwardly at a distance from said third opening defining means, fifth opening defining means in said one side portion of said pair of opposite side portions of said shell for the passage of said cable means therethrough, cable tensioning means on said ski boot and cable anchoring means on said shell portion, said cable means including a first section thereof extending inside said shell from said cable tensioning means to said first opening defining means, said cable tensioning means including a second section extending from said first section thereof through said first opening defining means outside said shell and inside with respect to one of said opposite lateral flap portions up to said second opening defining means, said cable means including a third section thereof extending from said second section thereof through said second opening defining means to the outside of said one lateral flap portion of said front quarter and around said rear quarter up to said third opening defining means, said cable means including a fourth section thereof extending from said third section thereof through said third opening defining means inside inside with respect to said another lateral flap portion of said front quarter up to said fourth opening defining means, said cable means including a fifth section extending from said fourth section thereof through said fourth opening defining means to the inside of said shell inwardly over said instep portion thereof and overriding said presser element below said instep portion and up to said fifth opening defining means, said cable means having a sixth section extending from said fifth section through said fifth opening to the outside of said shell and inwardly of said one lateral flap portion and over said inside heel zone up to said cable anchoring means, thereby to cause said cable means to form outwardly over said rear quarter a first loop formation overriding outwardly said rear quarter and to form a second loop formation extending inwardly of said instep portion over said presser element and around said heel zone, to exert in use on said user's foot a securing action at at least two spaced apart points and simultaneously a closing action on said rear quarter and said front quarter when said tensioning means are actuated to tension said cable means.

2. A device according to claim 1, wherein said heel portion of said shell has a recessed area and wherein said fifth section of said cable means extends over said recessed area above said hell portion.

3. A device according to claim 1, wherein said rear quarter includes a rear outside surface having notch formations thereon and wherein said third section of said cable means is received in said notch formations.

4. A device according to claim 3, wherein said notch formations comprise a plurality of spaced apart notches distributed along the hight of said rear quarter.

5. A device according to claim 1, wherein said tensioning means are arranged on said shell and are accessible from the outside.

6. A device according to claim 1, wherein said cable means include a mechanism for controlling the tensioning degree of at least one section of said cable means.

7. A device according to claim 1, wherein said cable means include a mechanism for controlling the tensioning degree of said fifth section of said cable means independently from remaining sections of said cable means, said mechanism being arranged near said fourth opening defining means at said fourt section of said cable means.

8. A device according to claim 6, wherein said mechanism comprises means for increasing or diminishing the working length of said one section of said cable means, thereby controlling the tensioning degree of said one section of said cable means.

9. A device according to claim 6, wherein said mechanism comprises a nipple-like connection, including an externally threaded core formation rigid with an interrupted terminal portion of said cable means and an internally threaded bushing member in swivelling connection with another interrupted terminal portion of said cable means and in screwing engagement with said threaded core formation.

10. A device according to claim 1, further comprising a protecting plate located at said heel zone and cooperating with said sixth section of said cable means.

11. A device according to claim 10, in combination with an inner boot, wherein said protecting plate is connected to said inner boot.

12. In a ski boot having a shell with an instep zone defining instep portion and an inside heel zone defining heel portion opposite said instep portion, said heel portion having a recessed area, and opposite side portions connecting said instep portion with said heel portion, a front quarter hinged on said shell and having a pair of opposite lateral flap portions, said front quarter at least partially overlapping said instep portion and said opposite side portions and a rear quarter hinged on said shell and having an outside rear surface having notch formations thereon, and with a presser element in the zone of and below said instep portion and adapted to receive therein a user's foot with inner boot like means thereon, a closure and foot securing device comprising: cable means, first opening defining means in one of said opposite side portions at a distance from said heel portion for the passage of said cable means therethrough, second opening defining means in one of said opposite lateral flap portions of said front quarter, said second opening defining means being arranged rearwardly at a distance from said first opening defining means for the passage of said cable means through said second opening defining means, third opening defining means in another of said opposite lateral flap portions of said quarter for the passage therethrough of said cable means, fourth opening defining means in another of said opposite side portions of said shell forwardly at a distance from said third opening defining means, fifth opening defining means in said one side portion of said pair of opposite side portions of said shell for the passage of said cable means therethrough, cable tensioning means on said instep portion of said ski boot and accessible from outside, and cable anchoring means on said shell portion at another of said opposite side portions thereof, said cable means including a first section thereof extending inside said shell from said cable tensioning means to said first opening defining means, said cable tensioning means including a second section extending from said first section thereof through said first opening defining means outside said shell and inside with respect to one of said opposite lateral flap portions up to said second opening defining means, said cable means including a third section thereof extending from said second section thereof through said second opening defining means to the outside of said one lateral flap portion of said front quarter and around said rear quarter and in engagement with said notch formations up to said third opening defining means, said cable means including a fourth section thereof extending from said third section thereof through said third opening defining means inside inside with respect to said another lateral flap portion of said front quarter up to said fourth opening defining means, said cable means including a fifth section extending from said fourth section thereof through said fourth opening defining means to the inside of said shell inwardly over said instep portion thereof and overriding said presser element below said instep portion and up to said fifth opening defining means, said cable means having a sixth section extending from said fifth section through said fifth opening to the outside of said shell and inwardly of said one lateral flap portion and over said inside heel zone above said recessed area thereof and below said third section of said cable means up to said cable anchoring means, thereby to cause said cable means to form outwardly over said rear quarter a first loop formation overriding outwardly said rear quarter and to form a second loop formation extending inwardly of said instep portion over said presser element and around said heel zone, to exert in use on said user's foot a securing action at at least two spaced apart points and simultaneously a closing action on said rear quarter and said front quarter when said tensioning means are actuated to tension said cable means.

* * * * *